US006931875B1

(12) United States Patent
Allen et al.

(10) Patent No.: US 6,931,875 B1
(45) Date of Patent: Aug. 23, 2005

(54) COOLING VEST SYSTEM

(76) Inventors: Jeffrey Allen, 9102 Lingrove Rd., Brooksville, FL (US) 34613; Sylvia Allen, 9102 Lingrove Rd., Brooksville, FL (US) 34613

( * ) Notice: Subject to any disclaimer, the term of this patent is extended or adjusted under 35 U.S.C. 154(b) by 0 days.

(21) Appl. No.: 10/827,385

(22) Filed: Apr. 19, 2004

(51) Int. Cl.[7] ..... F25D 15/00
(52) U.S. Cl. ..... 62/237; 62/259.3
(58) Field of Search ..... 62/237, 457.2, 62/530, 259.3

(56) References Cited

U.S. PATENT DOCUMENTS 5,146,625 A * 9/1992 Steele et al. ..... 2/102
5,305,471 A * 4/1994 Steele et al. ..... 2/102
5,484,448 A * 1/1996 Steele et al. ..... 607/108

* cited by examiner

*Primary Examiner*—Melvin Jones

(57) ABSTRACT

A basic vest is formed of a rear panel and laterally disposed front panels. The panels are fabricated of a material of low thermal insulation capabilities. A plurality of pockets has two laterally spaced rectangular front sheets located on the exterior surface of the front panels and two laterally spaced rectangular rear sheets located on the exterior surface of the rear panel. Each sheet has peripheral edges stitched to an associated panel and a free peripheral edge. An opening with fasteners there adjacent allow a wearer to open and close the opening. The sheets are fabricated of a material of high thermal insulation capabilities. A plurality of cooling packs is adapted to be placed in the pockets for dissipating the cooling temperature to a wearer.

3 Claims, 3 Drawing Sheets

COOLING VEST SYSTEM

BACKGROUND OF THE INVENTION

1. Field of the Invention

The present invention relates to a cooling vest system and more particularly pertains to providing a vest with thermally efficient cooling of the upper torso, front and back, of a wearer.

2. Description of the Prior Art

The use of heating and cooling systems of known designs and configurations is known in the prior art. More specifically, heating and cooling systems of known designs and configurations previously devised and utilized for the purpose of heating and cooling a user are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,403,676 issued Jul. 9, 1946 to Modlinski relates to a heat and cold applicator. U.S. Pat. No. 5,484,448 issued Jan. 16, 1996 to Steele relates to a garment and method for cooling body temperature. U.S. Pat. No. 5,605,144 issued Feb. 25, 1997 to Simmons relates to a heating garment with pouch for accommodating inserted heating packets. Lastly, U.S. Pat. No. Des. 421,329 issued Mar. 7, 2000 to Adams relates to a garment for thermal treatment.

While these devices fulfill their respective, particular objectives and requirements, the aforementioned patents do not describe cooling vest system that allows providing a vest with thermally efficient cooling of the upper torso, front and back, of a wearer.

In this respect, the cooling vest system according to the present invention substantially departs from the conventional concepts and designs of the prior art, and in doing so provides an apparatus primarily developed for the purpose of providing a vest with thermally efficient cooling of the upper torso, front and back, of a wearer. Such system is particularly beneficial in alleviating the heat stress symptomatic to multiple sclerosis and burn victims.

Therefore, it can be appreciated that there exists a continuing need for a new and improved cooling vest system which can be used for providing a vest with thermally efficient cooling of the upper torso, front and back, of a wearer. In this regard, the present invention substantially fulfills this need.

SUMMARY OF THE INVENTION

In view of the foregoing disadvantages inherent in the known types of heating and cooling systems of known designs and configurations now present in the prior art, the present invention provides an improved cooling vest system. As such, the general purpose of the present invention, which will be described subsequently in greater detail, is to provide a new and improved cooling vest system and method which has all the advantages of the prior art and none of the disadvantages.

To attain this, the present invention essentially comprises a basic vest. The vest is adapted to be worn on the upper torso of a wearer. The vest is formed of a large rear panel. The vest is also formed with two laterally disposed small front panels. The panels are fabricated of a material with low thermal insulation capabilities. The material preferably has a 2 mil thickness plus or minus 10 percent. Airprene is a trademark of Airpene LLC of Beverly Hills, Calif. The front panels have exterior edges. The exterior edges are located adjacent to the sides of a wearer. The front panels have interior edges. The interior edges are located adjacent to the front of a wearer. A sliding fastener is provided between the exterior and interior edges. The rear panel has side edges. The side edges are located adjacent to the sides of a wearer. The front panels and the rear panel have interior surfaces and exterior surfaces. The interior surfaces face a wearer. The exterior surfaces face away from a wearer. Spaced upper edges are positionable above the shoulders of a wearer. Two rows of stitching are provided. The stitching couples the upper edges of the front panels to the upper edge of the rear panel. A neck opening is provided between the rows of stitching.

A pair of inserts is provided. The inserts are positionable adjacent to the sides of the wearer. The inserts have lateral edges stitched to the side edges of the rear panel and front panels. The inserts are fabricated of an elastic material. The elastic material is selected from the class of elastic materials. The class of elastic material includes plastic and rubber, natural and synthetic, and blends thereof. In this manner the range of motion of a wearer is increased. The basic vest also includes arm holes above the inserts.

Further provided is a plurality of pockets. The plurality of pockets include two laterally spaced rectangular front sheets. The front sheets are located on the exterior surface of the front panels on opposite sides of the sliding fastener. The plurality of pockets also includes two laterally spaced rectangular rear sheets. The rear sheets are located on the exterior surface of the rear panel and are generally laterally aligned with the front sheets at a higher elevation. Each sheet is between about 6 inches and 8 inches wide and about 12 inches and 15 inches high. Each sheet has a lower peripheral edge. The lower peripheral edge is stitched to an associated panel. Each sheet has side peripheral edges. The side peripheral edge is stitched to an associated panel. Each sheet further has a free upper peripheral edge. In this manner an opening with a hook and loop fasteners is formed there adjacent. Pull tabs are provided there above. In this manner a wearer is allowed to open and close the opening. The sheets are fabricated of a material of high thermal insulation capabilities. The material preferably has a 3 mil thickness plus or minus 10 percent.

Provided last is a plurality of similarly sized and shaped rectangular cooling packs. Each cooling pack has a width of between about 5 inches and 7 inches, a height of about 11 inches and 14 inches and a thickness of between about 0.25 inches and about 0.75 inches. The cooling packs are adapted to be initially placed in a cooling chamber such as a freezer. In this manner the cooling packs are cooled. The cooling packs are adapted to be subsequently placed in the pockets. In this manner the cooling temperature may be dissipated to a wearer. The sheets are located exteriorly of the cooling packs. The sheets are of greater thermal insulating properties than the panels. The sheets are located interiorly of the cooling packs for greater thermal efficiency of the system when cooling a wearer.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cooling vest system which has all of the advantages of the prior art heating and cooling systems of known designs and configurations and none of the disadvantages.

It is another object of the present invention to provide a new and improved cooling vest system which may be easily and efficiently manufactured and marketed.

It is further object of the present invention to provide a new and improved cooling vest system which is of durable and reliable constructions.

An even further object of the present invention is to provide a new and improved cooling vest system which is susceptible of a low cost of manufacture with regard to both materials and labor, and which accordingly is then susceptible of low prices of sale to the consuming public, thereby making such cooling vest system economically available to the buying public.

Even still another object of the present invention is to provide a cooling vest system for providing a vest with thermally efficient cooling of the upper torso, front and back, of a wearer.

Lastly, it is an object of the present invention to provide a new and improved cooling vest system. A basic vest is formed of a rear panel and laterally disposed front panels. The panels are fabricated of a material of low thermal insulation capabilities. A plurality of pockets has two laterally spaced rectangular front sheets located on the exterior surface of the front panels and two laterally spaced rectangular rear sheets located on the exterior surface of the rear panel. Each sheet has peripheral edges stitched to an associated panel and a free peripheral edge. An opening with fasteners there adjacent allow a wearer to open and close the opening. The sheets are fabricated of a material of high thermal insulation capabilities. A plurality of cooling packs is adapted to be placed in the pockets for dissipating the cooling temperature to a wearer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
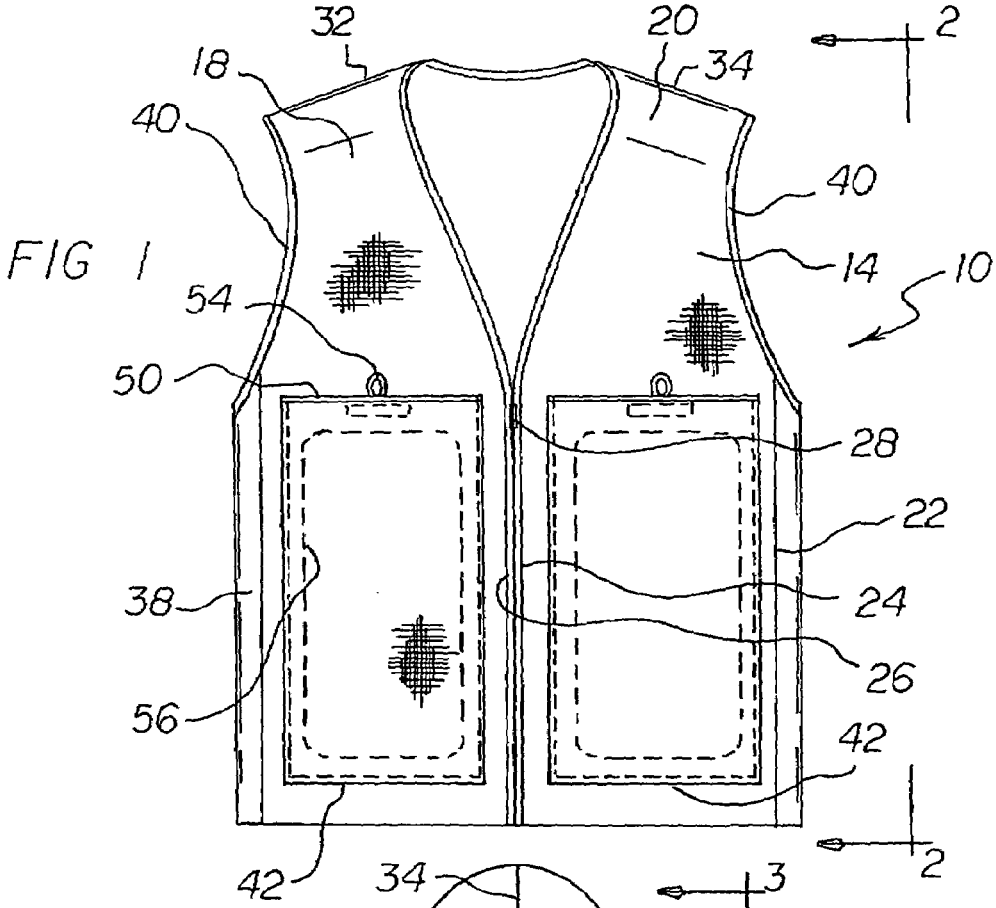
FIG. 1 is a front elevational view of a cooling vest system constructed in accordance with the principles of the present invention.
Figure 2:
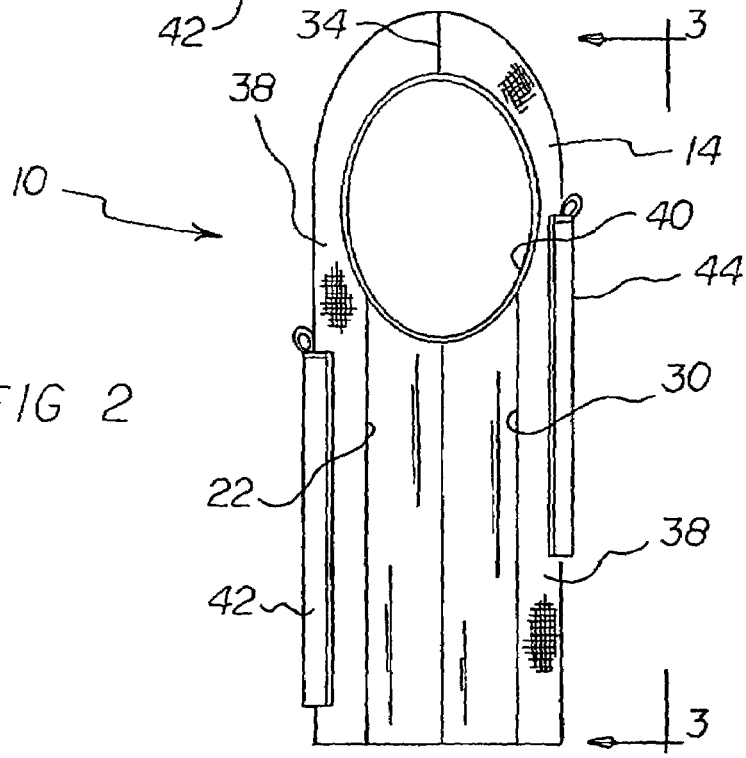
FIG. 2 is a side elevational view of the system taken at line 2—2 of FIG. 1.
Figure 3:
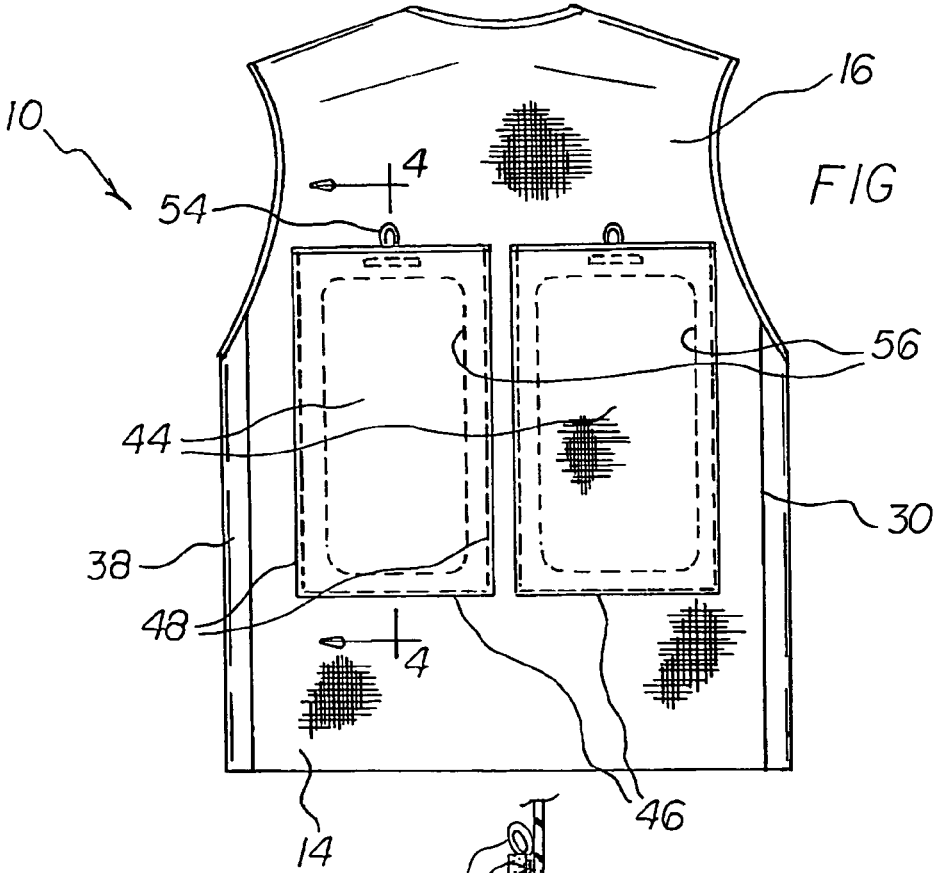
FIG. 3 is a rear elevational view of the system of the prior Figures.
Figure 4:
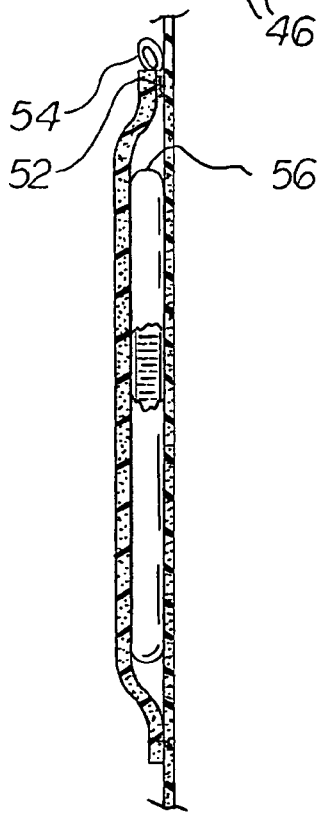
FIG. 4 is a cross sectional view taken along line 4—4 of FIG. 3.
Figure 5:
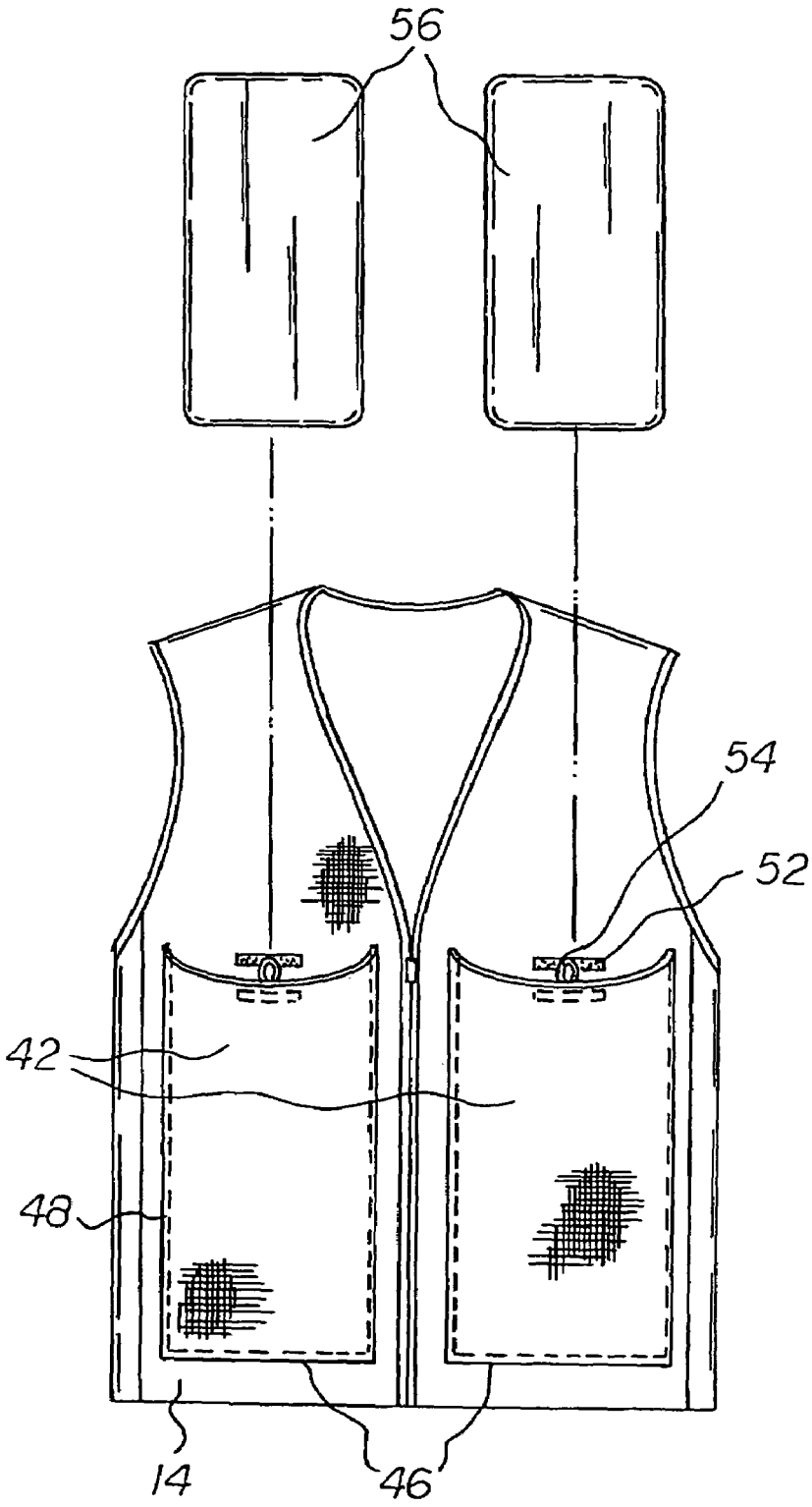
FIG. 5 is a front perspective illustration of the system of the prior Figures.

With reference now to the drawings, and in particular to FIG. 1 thereof, the preferred embodiment of the new and improved cooling vest system embodying the principles and concepts of the present invention and generally designated by the reference numeral 10 will be described.

The present invention, the cooling vest system 10 is comprised of a plurality of components. Such components in their broadest context include a basic vest, a plurality of pockets, a plurality of cooling packs. Such components are individually configured and correlated with respect to each other so as to attain the desired objective.

First provided is a basic vest 14. The vest is adapted to be worn on the upper torso of a wearer. The vest is formed of a large rear panel 16. The vest is also formed with two laterally disposed small front panels 18, 20. The panels are fabricated of a material with low thermal insulation capabilities. The material is preferably Airprene with a 2 mil thickness plus or minus 10 percent. Airprene is a trademark of Airpene LLC of Beverly Hills, Calif. The front panels have exterior edges 22. The exterior edges are located adjacent to the sides of a wearer. The front panels have interior edges 24, 26. The interior edges are located adjacent to the front of a wearer. A sliding fastener 28 is provided between the exterior and interior edges. The rear panel has side edges 30. The side edges are located adjacent to the sides of a wearer. The front panels and the rear panel have interior surfaces and exterior surfaces. The interior surfaces face a wearer. The exterior surfaces face away from a wearer. Spaced upper edges are positionable above the shoulders of a wearer. Two rows of stitching 32, 34 are provided. The stitching couples the upper edges of the front panels to the upper edge of the rear panel. A neck opening is provided between the rows of stitching.

A pair of inserts 38 is provided. The inserts are positionable adjacent to the sides of the wearer. The inserts have lateral edges stitched to the side edges of the rear panel and front panels. The inserts are fabricated of an elastic material. The elastic material is selected from the class of elastic materials. The class of elastic material includes plastic and rubber, natural and synthetic, and blends thereof. The material is preferably spandex. In this manner the range of motion of a wearer is increased. The basic vest also includes arm holes 40 above the inserts.

Further provided is a plurality of pockets. The plurality of pockets include two laterally spaced rectangular front sheets 42. The front sheets are located on the exterior surface of the front panels on opposite sides of the sliding fastener. The plurality of pockets also includes two laterally spaced rectangular rear sheets 44. The rear sheets are located on the exterior surface of the rear panel and are generally laterally aligned with the front sheets at a higher elevation. Each sheet is between about 6 inches and 8 inches wide and about 12 inches and 15 inches high. Each sheet has a lower peripheral edge 46. The lower peripheral edge is stitched to an associated panel. Each sheet has side peripheral edges 48. The side peripheral edge is stitched to an associated panel. Each sheet further has a free upper peripheral edge 50. In this manner an opening with a hook and loop fasteners 52 is formed there adjacent. Pull tabs 54 are provided there above. In this manner a wearer is allowed to open and close the opening. The sheets are fabricated of a material of high thermal insulation capabilities. The material is preferably neoprene with a 3 mil thickness plus or minus 10 percent.

Provided last is a plurality of similarly sized and shaped rectangular cooling packs 56. Each cooling pack has a width of between about 5 inches and 7 inches, a height of about 11 inches and 14 inches and a thickness of between about 0.25 inches and about 0.75 inches. The cooling packs are adapted to be initially placed in a cooling chamber such as a freezer. In this manner the cooling packs are cooled. The cooling packs are adapted to be subsequently placed in the pockets. In this manner the cooling temperature may be dissipated to a wearer. The sheets are located exteriorly of the cooling packs. The sheets are of greater thermal insulating properties than the panels. The sheets are located interiorly of the cooling packs for greater thermal efficiency of the system when cooling a wearer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A cooling vest system for providing a vest with thermally efficient cooling of the upper torso, front and back, of a wearer comprising, in combination:

a basic vest adapted to be worn on the upper torso of a wearer and formed of a large rear panel and two laterally disposed small front panels, the panels being fabricated of a material of low thermal insulation capabilities with a 2 mil thickness plus or minus 10 percent, the front panels having exterior edges located adjacent to the sides of a wearer and interior edges located adjacent to the front of a wearer with a sliding fastener there between, the rear panel having side edges located adjacent to the sides of a wearer, the front panels and the rear panel having interior surfaces facing a wearer and exterior surfaces facing away from a wearer and also having spaced upper edges positionable above the shoulders of a wearer with two rows of stitching coupling the upper edges of the front panels to the upper edge of the rear panel and with a neck opening between the rows of stitching;

a pair of inserts positionable adjacent to the sides of the wearer with lateral edges stitched to the side edges of the rear panel and front panels, the inserts being fabricated of an elastic material selected from the class of elastic materials including plastic and rubber, natural and synthetic, and blends thereof to thereby increase the range of motion of a wearer, the basic vest also including arm holes above the inserts;

a plurality of pockets including two laterally spaced rectangular front sheets located on the exterior surface of the front panels on opposite sides of the sliding fastener, the plurality of pockets also including two laterally spaced rectangular rear sheets located on the exterior surface of the rear panel generally laterally aligned with the front sheets at a higher elevation, each sheet being between about 6 inches and 8 inches wide and about 12 inches and 15 inches high, each sheet having a lower peripheral edge stitched to an associated panel and side peripheral edges stitched to an associated panel with a free upper peripheral edge forming an opening with a hook and loop fasteners there adjacent with pull tabs there above for allowing a wearer to open and close the opening, the sheets being fabricated of a material of high thermal insulation capabilities with a 3 mil thickness plus or minus 10 percent; and a plurality of similarly sized and shaped rectangular cooling packs, each cooling pack having a width of between about 5 inches and 7 inches and having a height of about 11 inches and 14 inches and having a thickness of between about 0.25 inches and about 0.75 inches, the cooling packs adapted to be initially placed in a cooling chamber such as a freezer for thereby being cooled, the cooling packs being adapted to be subsequently placed in the pockets for dissipating the cooling temperature to a wearer, the sheets located exteriorly of the cooling packs being of greater thermal insulating properties than the panels located interiorly of the cooling packs for greater thermal efficiency of the system when cooling a wearer.

2. A cooling vest system comprising:

a basic vest formed of a rear panel and laterally disposed front panels fabricated of Airprene;

a plurality of pockets including two laterally spaced rectangular front sheets located on the exterior surface of the front panels and two laterally spaced rectangular rear sheets located on the exterior surface of the rear panel, each sheet having peripheral edges stitched to an associated panel and a free peripheral edge forming an opening with fasteners there adjacent for allowing a wearer to open and close the opening, the sheets being fabricated of neoprene; and a plurality of cooling packs being adapted to be placed in the pockets for dissipating the cooling temperature to a wearer.

3. A cooling vest system comprising:

a basic vest formed of a rear panel and laterally disposed front panels fabricated of a breathable, stretchable, elastometric synthetic rubber material with low thermal insulating capabilities;

a plurality of pockets including two laterally spaced rectangular front sheets located on the exterior surface of the front panels and two laterally spaced rectangular rear sheets located on the exterior surface of the rear panel, each sheet having peripheral edges stitched to an associated panel and a free peripheral edge forming an opening with fasteners there adjacent for allowing a wearer to open and close the opening, the sheets being fabricated of neoprene with high thermal insulating capabilities; and a plurality of cooling packs being adapted to be placed in the pockets for dissipating the cooling temperature to a wearer.

* * * * *